US005509653A

United States Patent [19]

Parsons

[11] Patent Number: 5,509,653

[45] Date of Patent: Apr. 23, 1996

[54] EXPANDABLE BATON WITH RESILIENT MEMBER MOUNTED IN TIP

[75] Inventor: Kevin L. Parsons, Appleton, Wis.

[73] Assignee: Armament Systems and Procedures, Inc., Appleton, Wis.

[21] Appl. No.: 315,106

[22] Filed: Sep. 29, 1994

Related U.S. Application Data

[62] Division of Ser. No. 129,901, Sep. 30, 1993, Pat. No. 5,407,197.

[51] Int. Cl.[6] ..... F41B 15/02

[52] U.S. Cl. ..... 273/84 R

[58] Field of Search ..... 273/84 R, 84 ES, 273/80 D, 32 F, 68, 69, 456; 135/75; 16/115; 343/901

[56] References Cited

U.S. PATENT DOCUMENTS

| | | | |
|---|---|---|---|
| 1,347,382 | 7/1920 | Karro | 273/456 |
| 3,106,398 | 10/1960 | Gowdey | 273/84 R |
| 4,752,072 | 6/1988 | Parsons | 273/84 R |
| 5,372,363 | 12/1994 | Siddle | 273/84 R |

FOREIGN PATENT DOCUMENTS

| | | | |
|---|---|---|---|
| 1079320 | 6/1980 | Canada | 273/84 R |

*Primary Examiner*—William M. Pierce

*Attorney, Agent, or Firm*—Robert C. Curfiss; Butler & Binion

[57] ABSTRACT

A plurality of accessories which may be assembled in a kit in a compact carrying case for modifying an expandable baton for multiple uses. The kit includes two expandable batons, a coupler, interchangeable tips and a carrying case. Each expandable baton includes a telescoping end with a removable tip and a handle with a threaded end covered by an endcap. The removable tip is specifically designed to include a circumferential resilient member which prevents the tip from accidently disengaging from the baton while being easily interchangeable. The coupler is readily secured to the threaded end of each baton to form a riot control device which is expanded by a rapid single twisting motion. The baton may also be modified for use as a search tool by replacing the interchangeable tip of the baton with any of a plurality of interchangeable tips. The interchangeable tips may also be used with a shorter baton, such as a keyring baton.

2 Claims, 3 Drawing Sheets

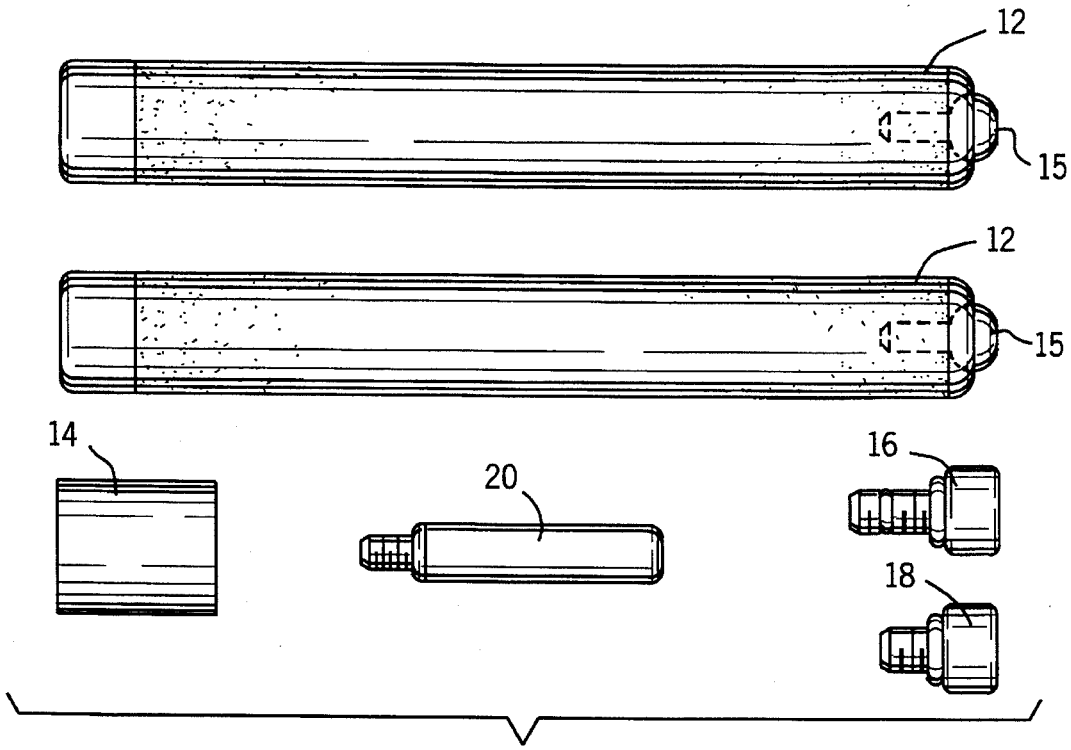
FIG. 3
FIG. 4
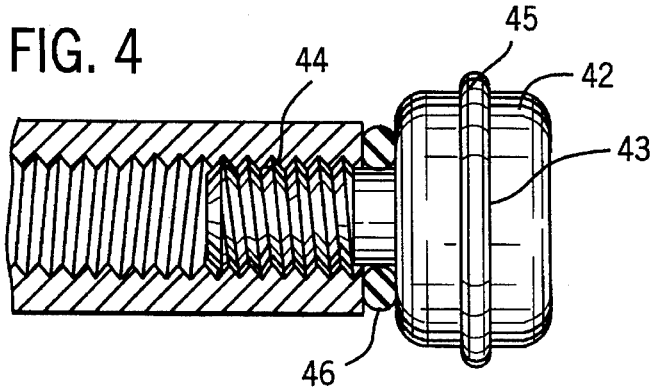
FIG. 5
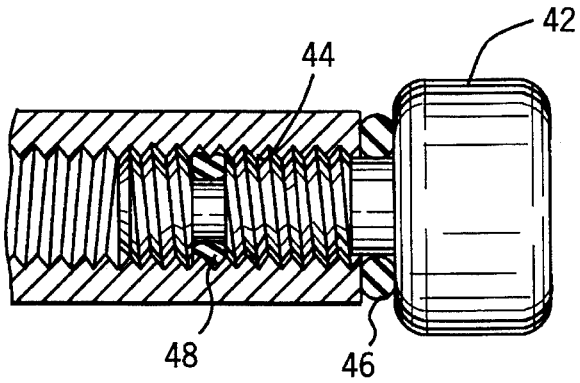

EXPANDABLE BATON WITH RESILIENT MEMBER MOUNTED IN TIP

This application is a divisional of application Ser. No. 08/129,901 filed Sep. 30, 1993, now U.S. Pat. No. 5,407, 197.

BACKGROUND OF INVENTION

1. Field of Invention

The subject invention is generally related to nightsticks, batons and intermediate force weapons and is specifically directed to a kit for modifying an expandable baton for any of a plurality of multiple uses.

2. Description of the Prior Art

Nightsticks and batons are well known and have gained widespread acceptance as intermediate force weapons for use by law enforcement personnel. One of the best known intermediate force weapons is the ASP Expandable Baton manufactured by Armament Systems and Procedures, the assignee of the subject application. Typically, the ASP Baton includes three telescoping sections, the outer largest section defining a handle adapted for receiving and nesting the remaining sections when the baton is in a collapsed position. In early batons, the tip was permanently secured by first installing the threaded tip and then drilling a hole through the baton and tip and inserting a lock pin through the hole. The insertion of a lock pin prevented the tip from both rotation and axial movement. In order to remove the tip, the baton had to be returned to the manufacturer to have the pin knocked out. Thus, this method of permanently securing the tip was expensive in manufacturing, removal and replacement. It has been desirable for an expandable baton to have a replaceable tip which can be easily replaced if the tip of an officer's baton becomes scarred during use in breaking windows or similar activities. Also, it may be necessary to remove the tip in order to disassemble a baton that needs to be repaired.

While it is desirable for law enforcement personnel to have an expandable baton with a replaceable tip, it is extremely important, for the safety of the officer and others, to ensure that the replaceable tip would not accidently separate from the baton, particularly after repeated uses. The permanent prior art tip does this. Other prior art methods for increasing the resistance to prevent the tip from accidently separating from the baton include the use of a nylon insert plug or patch at the base of the tip. However, such methods are extremely expensive and require secondary manufacturing operations. Although the use of an adhesive is also possible, the adhesive cannot be broken with finger pressure and often requires an auxiliary activity such as heating the tip to break the adhesive. Further, once the adhesive is broken, the adhesive must be reapplied in order to reseal the tip in place.

In addition to nightsticks or batons, law enforcement personnel are required to carry or have available weapons for other uses such as riot control and searches. For example, law enforcement personnel must carry or have access to riot batons and various search tools. Typically, law enforcement personnel carry intermediate force batons, portable two-way radios, firearms, ammunition, handcuffs, chemical irritants and flashlights. Thus, the addition of riot control and search equipment would undesirably increase the large amount of equipment already carried on the person.

In a riot situation, an officer generally uses a riot baton consisting of a long rod which the officer holds in front of himself for crowd control. While prior art riot batons maybe effective, they are not suitable for day-to-day police duty use. In fact, the only use for such a rod is for riots. Further, traditional riot batons are made in a standard size and it is not possible to vary the length. Because officers vary dramatically in size, the prior art riot batons may not be the appropriate length for some officers. Thus, prior art riot batons are difficult for officers to carry with them and cannot be customized to fit an individual officer.

When a search of a premises must be conducted, extendable tools are often used to search above doors and other out of reach areas. While expandable batons may be used to conduct searches of out of reach areas, a typical expandable baton includes a spherical tip and is not designed to reach into extremely small or high places. Further, although an officer searching with a baton may avoid the danger of being cut by hidden razor blades, needles or other edged weapons, a baton search may fail to reveal hidden weapons if the baton does not come into direct contact with them.

In a body search, short sticks, such as the ASP Keyring Baton, U.S. Pat. No. 4,752,072, have been used as search tools by law enforcement personnel for a number of years. In fact, law enforcement personnel may be required to use such a search tool over searches involving female subjects, especially where a male officer is searching a female subject. By rubbing the tool over the pocket and clothing of individuals, it is possible for officers to literally "feel" for hidden weapons and "hear" contact with weapons without the danger of being cut by razor blades, needles, fish hooks or edged weapons that may be hidden on the individual. With the dramatic increase in hepatitis and HIV, law enforcement personnel who stick their hand into a subject's pocket are engaged in a potentially lethal activity. Thus, because of the dangers involved in conducting premises or individual searches, law enforcement personnel must have appropriate search tools and may find it necessary to carry additional equipment for retrieving hypodermic needles, fish hooks, razor blades and edged weapons once they are detected.

Therefore, there is a need for an inexpensive means for preventing a removable tip from accidently disengaging from an expandable baton while still allowing the tip to be easily removed and installed a number of times. There is also a need for a variety of tools which may, where desired, be offered in a kit form for modifying a single purpose intermediate force weapon for multiple uses in order to reduce the amount of additional equipment to be carried by law enforcement personnel.

SUMMARY OF THE INVENTION

The subject invention is directed to a plurality of accessories which may be assembled in a kit in a compact carrying case for modifying an expandable baton for multiple uses thereby reducing the amount of additional equipment to be carried by law enforcement personnel. An officer using the accessories or the kit may modify his duty baton to create a riot control device and various search tools, as well. The removable tip of the expandable baton is specifically designed to permit the tip to be easily interchanged while at the same time prevent the tip from accidently disengaging from the baton.

In the preferred embodiment, the kit includes a carrying case containing two expandable batons, a coupler and various interchangeable tips. The carrying case is a compact, hinged case having insets for storing and transporting each of the accessories included in the kit. The coupler is specifically designed to join two serviceable expandable batons together to create a riot baton. The coupler is readily secured to the bottom portion of the handle of each baton and forms the center area of the riot baton. The riot baton is expanded by grasping the center and rapidly twisting the baton. Once expanded, the joined expandable batons can be effectively used as a riot control device.

Moreover, the coupler of the subject invention allows various sizes of batons to be joined together so it is possible to create a riot baton that is the correct size for virtually any officer. Further, the rapid and simultaneous expansion of both telescoping ends created by the centrifugal force of a single twisting motion enhances the inherent psychological deterrence of the expandable baton. Because a duty baton forms the basis for the riot baton of the subject invention, law enforcement personnel have ready access to a riot control device without having to carry a cumbersome additional equipment such as a traditional riot baton.

Each of the expandable batons may also include a uniquely designed removable tip. The removable tip of the preferred embodiment has a top section and threaded shaft and is threadably secured to the telescoping end of the baton. In the preferred embodiment, two circumferential resilient members, such as by way of example, O-rings, are used to provide resistance throughout the tip for preventing the tip from working its way out after repeated use and separating from the baton. The first O-ring is positioned at the top of the shaft and creates an area of initial resistance. The second O-ring is also applied at the base of the shaft to provide increased resistance throughout the threaded area of the tip. The use of a secondary O-ring, which interferes with the major diameter of either the male or female mating thread, provides enough resistance to cause the threads to become self-locking when the tip is installed. Further, use of a secondary O-ring is cost effective, easily repaired and allows the tip to be installed and removed a number of times.

The preferred embodiment of the invention also includes interchangeable tips for use with the expandable batons. In a search situation, the standard tip, a button tip having a mushroom shape, may be removed and replaced with a elongated, cylindrical, wand-style search tip. The wand-style tip increases the length of the expandable baton and may include the double O-ring locking design. The increased length and shape of the expandable baton having a wand-style search tip allows law enforcement officers to conduct a thorough search of out of reach areas.

In addition, either the standard button tip or wand-style tip may include a magnet for picking up hypodermic needles, fish hooks, razor blades and other edged or sharp weapons. Neodymium rare earth magnets are the strongest magnets currently available. Preferably, a neodymium rare earth magnet having 2.6 pounds of pull is inserted into the end of the tip to create a magnetic standard button tip or magnetic wand-style tip.

The interchangeable tips of the preferred embodiment may also replace the removable standard button tip of a shorter baton, such as the ASP Keyring Baton, to create an effective search tool for use in searching an individual. In particular, a magnetic button or wand-style tip may be rubbed over the pockets and clothing of an individual to quickly locate and retrieve hidden weapons. In addition, the tips may include an element adapted to frictionally engage material whereby the tip may be inserted in the pocket of a suspect, twisted to engage the material and withdrawn to turn the pocket inside out.

Therefore, it is an object and feature of the subject invention to provide a plurality of accessories for modifying a single purpose intermediate force weapon for multiple uses.

It is also an object and feature of the subject invention to provide a kit containing the accessories for modifying a single purpose intermediate force weapon for multiple uses.

It is also an object and feature of the subject invention to provide an expandable baton with a removable tip having a design which prevents the tip from accidently disengaging from the baton, particularly after repeated uses.

It is a further object and feature of the subject invention to provide a coupler for joining two serviceable expandable batons together to create a riot control device.

It is a further object and feature of the subject invention to provide interchangeable tips for modifying an expandable baton for use as a search tool.

It is yet another object and feature to provide interchangeable tips having a design which prevents the tip from accidently disengaging from the baton, particularly after repeated uses.

It is a further object and feature to provide interchangeable tips having a design whereby the tip may be inserted in a pocket and twisted to turn the pocket inside out.

It is also an object and feature to provide a compact case which is easily transported for carrying the expandable batons, coupler and interchangeable tips.

Other objects and features will be readily apparent from the accompanying drawings and description.

BRIEF DESCRIPTION OF THE DRAWINGS

FIG. 3 is a perspective view of the various accessories of the subject invention and adapted to be contained in the carrying case.

FIG. 4 is an enlarged cross-sectional view illustrating a tip having a single resilient locking member and a fabric engaging element, as threaded into the telescoping end of the baton.

FIG. 5 is an enlarged cross-sectional view illustrating a tip having two resilient locking members, as threaded into the telescoping end of the baton.

DETAILED DESCRIPTION OF THE DRAWINGS

Figure 2:
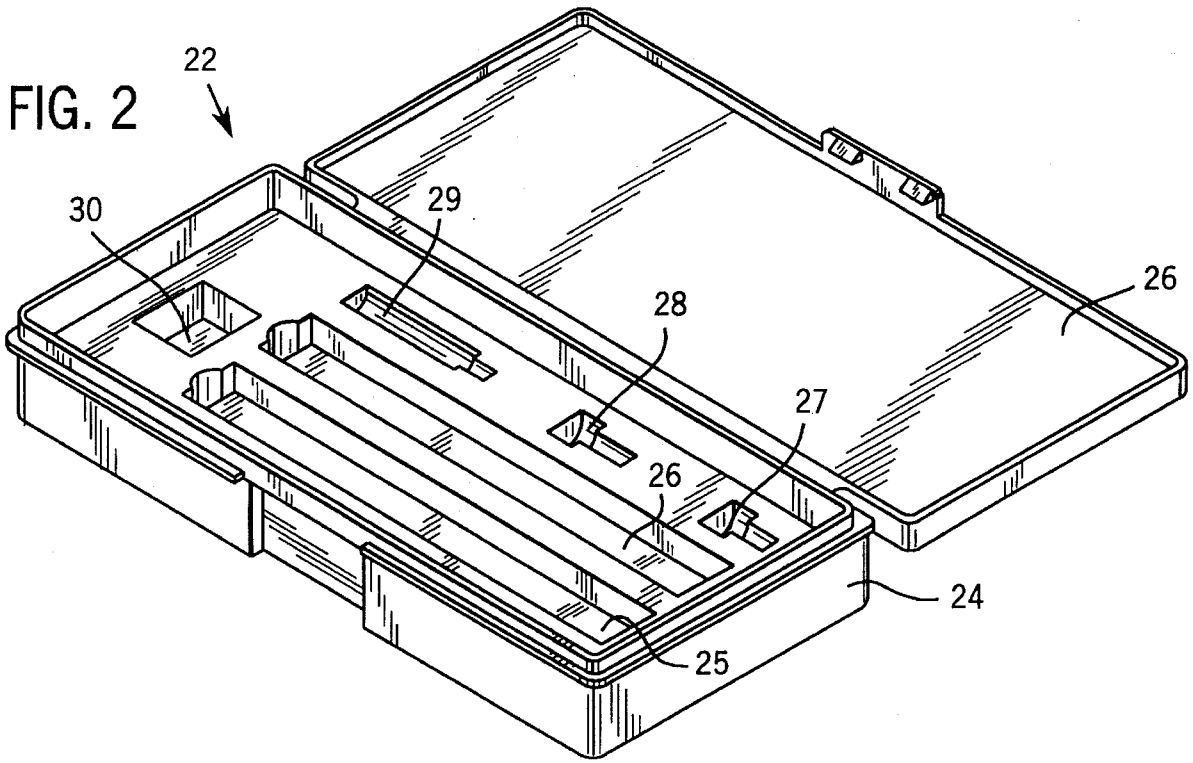
FIG. 2 is a perspective view of the carrying case in an open position showing recesses for the various accessories.

The various accessories of the subject invention are shown in FIG. 3. The accessories include two expandable batons 12, a coupler 14 and three interchangeable tips 16, 18 and 20. As shown in FIG. 2, a case 22 may be provided for housing one or more batons and one or more of the accessories. The case 22 may be a rectangular box 24 having a hinged lid 26 which may be snapped shut. As illustrated in FIG. 2, the preferred embodiment of the case 22 includes recesses 25–30 for storing and transporting the accessories of the preferred embodiment.

Figure 1:
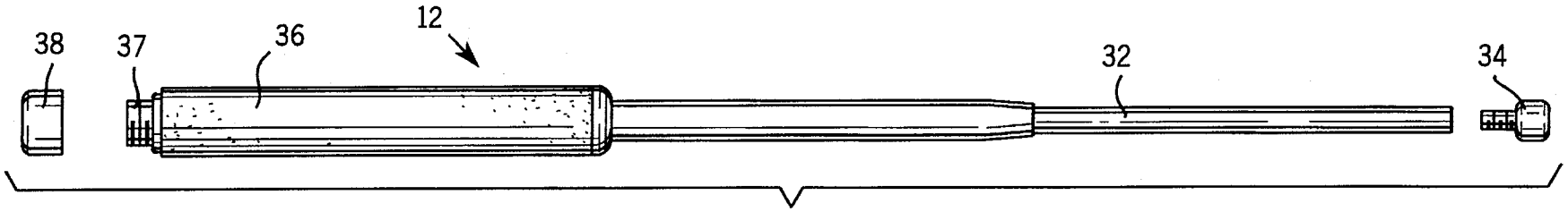
FIG. 1 is a perspective view of an expanded baton including an exploded view of the threaded tip and of the endcap removed to expose the threaded end.
Figure 6:
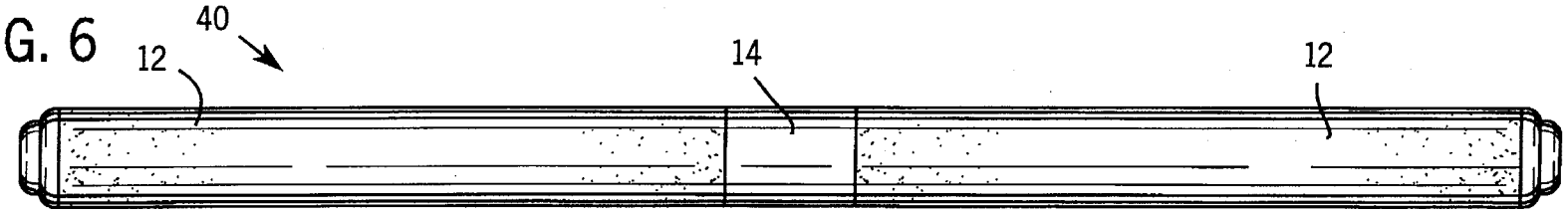
FIG. 6 is a perspective view of two batons joined by the coupler to form a riot control device.
Figure 7:
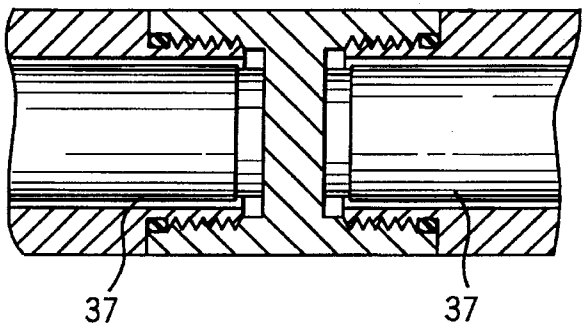
FIG. 7 is an enlarged cross-sectional view of the threaded ends of the batons joined by the coupler.
Figure 8:
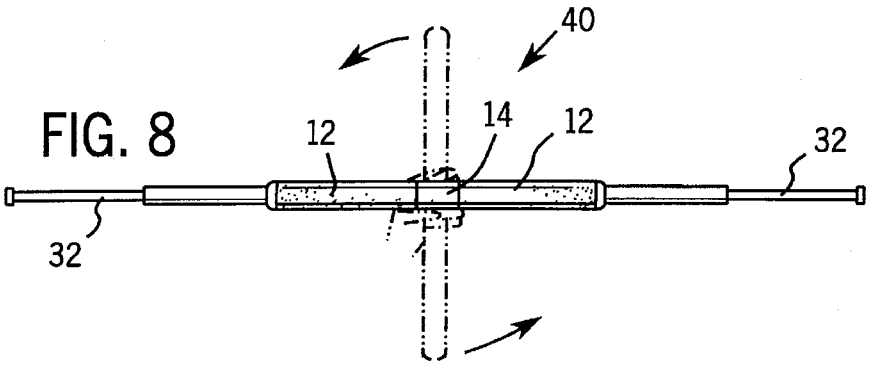
FIG. 8 is a plan view illustrating the twisting motion for expanding the riot control device.

As shown in FIG. 1, each expandable baton 12 in the kit includes telescoping ends 31, 32, the telescoping end 32 having a removable tip 34, and a handle 36 having a removable endcap 38. When the endcap is removed, a threaded male end 37 of the handle 36 is exposed. In the preferred embodiment, the kit includes a cylindrical coupler 14 which is internally threaded to receive the threaded end 37 of each baton 12 (see FIG. 7). The coupler 14 is specifically designed to join the expandable batons 12 in an end to end relationship to form the riot control device 40, as shown in FIG. 6. The coupler 14 forms the center area of the riot control device 40 with the telescoping ends 32 of each baton 12 at opposite ends of the device. As illustrated in FIG. 8, the riot control device 40 may be expanded by grasping the center area and rapidly applying a single twist to the device. Once expanded, the joined expandable batons 12 can be effectively used as a riot control device.

Each of the expandable batons 12 of the preferred embodiment may include a uniquely designed removable tip 34. The removable tip 34 has a top section 42 and a threaded shaft 44 and is threadably secured to the telescoping end 32 of each baton 12. In order to increase resistance and prevent the tip 34 from separating from the baton, a circumferential resilient member, such as by way of example, an O-ring, may be positioned on the shaft 44 of the tip. As shown in the enlarged cross-sectional view of FIG. 4, an O-ring 46 may be positioned at the top of the shaft 44 adjacent to the top section 40 of the tip. As also shown in FIG. 4, any of the tips may include a circumferential recessed channel 43 adapted for holding a circumferential resilient member, such as an O-ring 45 which has an outer surface which would frictionally engage material whereby the tip maybe inserted in the pocket of an individual, twisted to engage the material and withdrawn to turn the pocket inside out.

The preferred embodiment of the removable tip may include a secondary O-ring 48 positioned at the base of the shaft 44 in addition to the O-ring 46 positioned at the top of the shaft. FIG. 5 illustrates a tip having a first O-ring 46 positioned at the top of the shaft 44 and a secondary O-ring 48 at the base to provide increased resistance throughout the tip. As shown in FIG. 5, the secondary O-ring 48 interferes with the major diameter of either the male or female mating thread of the shaft 44, causing the threads to become self-locking when the tip is secured to the telescoping end 32. The invention may also include a removable tip having an O-ring 46 positioned only at the top of the shaft or an O-ring 48 positioned only at the base of the shaft or may include both O-rings.

The preferred embodiment of the subject invention also includes interchangeable tips 16, 18 and 20, shown in FIG. 3, for use with either expandable baton 12. The expandable baton 12 typically includes a standard mushroom-shaped button tip 15. The standard button tip 15 may be interchanged with an elongated cylindrical wand-style tip 20. In addition, the standard button tip 15 or wand-style tip 20 may include a magnet. In the preferred embodiment, a neodymium rare earth magnet is inserted into the end of a tip to create a magnetic button tip or magnetic wand-style tip having 2.6 pounds of pull. The kit of the preferred embodiment includes a magnetic button tip 18, a standard button tip 16 having a first and second O-ring for increased resistance and a wand-style tip 20. If desired, any or all of the tips may include a magnet and/or a secondary O-ring. In addition, the kit and carrying case of the subject invention may be varied to include additional tips or other accessories.

Figure 9:
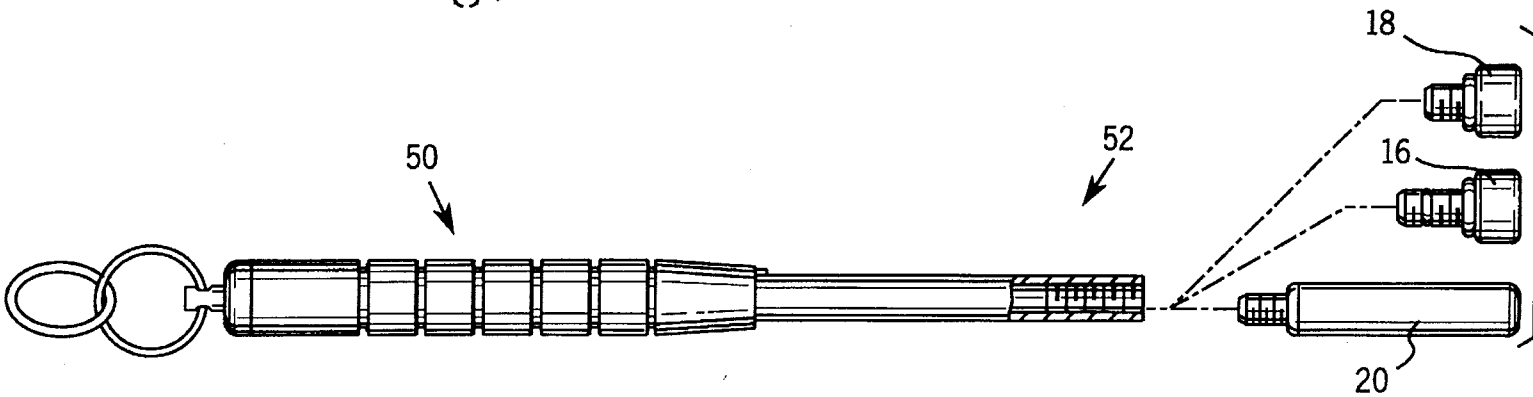
FIG. 9 is a perspective view of a baton key ring and interchangeable tips.

The tip accessories of the subject invention are also useful with a shorter baton 50, such as the ASP Baton keyring, for use in conducting searches of individuals. The shorter baton 50 includes a removable tip 52. The removable tip 52 may include a single O-ring, as shown in FIG. 4, a double O-ring assembly, as shown in FIG. 5 or may include a single O-ring located at the base of the shaft. As shown in FIG. 9, the removable tip may be replaced with any of the interchangeable tips 16, 18 or 20 included in the kit. In the preferred embodiment, the tips of the baton 12 and 50 are interchangeable.

While specific embodiments and features of the invention have been disclosed herein, it will be readily understood that the invention encompasses all enhancements and modifications within the scope and spirit of the following claims.

What is claimed is:

1. An expandable baton having a telescoping end and a handle, the telescoping end having an internally threaded bore for receiving a removable tip, the removable tip comprising, an upper section and a lower section, the lower section having a threaded shaft for threadably securing the tip to the baton and wherein the tip includes a fabric engaging element and the upper section further comprising a circumferential recess and the fabric engaging element mounted in the recess.

2. The expandable baton of claim 1, wherein the fabric engaging element is an o-ring.

* * * * *

UNITED STATES PATENT AND TRADEMARK OFFICE

CERTIFICATE OF CORRECTION

PATENT NO. : 5,509,653

DATED : April 23, 1996

INVENTOR(S) : Kevin L. Parsons

It is certified that error appears in the above-identified patent and that said Letters Patent is hereby corrected as shown below:

Claim 1, Col. 6, Line 44, after "recess" insert -- wherein the fabric engaging element is a resilient member --

Signed and Sealed this

Thirtieth Day of July, 1996

Bruce Lehman

*Attest:*

BRUCE LEHMAN

*Attesting Officer*

*Commissioner of Patents and Trademarks*